US006854308B2

(12) United States Patent
Shieh

(10) Patent No.: US 6,854,308 B2
(45) Date of Patent: Feb. 15, 2005

(54) DOOR LOCK

(75) Inventor: Huang-Chin Shieh, Taichung Hsien (TW)

(73) Assignees: Chun-Peng Liu, Taichung Hsien (TW); Song-Yuan Huang, Taichung Hsien (TW)

( * ) Notice: Subject to any disclaimer, the term of this patent is extended or adjusted under 35 U.S.C. 154(b) by 0 days.

(21) Appl. No.: 10/810,597

(22) Filed: Mar. 29, 2004

(65) Prior Publication Data

US 2004/0194518 A1 Oct. 7, 2004

(30) Foreign Application Priority Data

Apr. 3, 2003 (CN) ..... 03244511 U
Apr. 3, 2003 (CN) ..... 03244513 U

(51) Int. Cl.[7] ..... E05B 13/00

(52) U.S. Cl. ..... 70/472; 70/149; 70/218; 70/223; 292/142; 292/DIG. 27

(58) Field of Search ..... 70/188–190, 149, 70/472, 218, 222, 223, 422; 292/39, 51, 142, 199, DIG. 27, 336.3, DIG. 31

(56) References Cited

U.S. PATENT DOCUMENTS 1,511,956 A * 10/1924 Ernest ..... 292/172
1,720,590 A * 7/1929 Evans ..... 70/129
1,968,285 A * 7/1934 Egan ..... 292/172
4,384,465 A * 5/1983 Muus ..... 70/129
4,809,526 A * 3/1989 Shen ..... 70/107
5,072,977 A * 12/1991 Millman et al. ..... 292/336.3
5,496,082 A * 3/1996 Zuckerman ..... 292/336.3
5,707,090 A * 1/1998 Sedley ..... 292/172
6,023,952 A * 2/2000 Mantarakis et al. ..... 70/99
6,178,795 B1 * 1/2001 Hsueh ..... 70/472
6,217,087 B1 * 4/2001 Fuller ..... 292/39
6,327,880 B1 * 12/2001 Liang ..... 70/106
6,585,302 B2 * 7/2003 Lin ..... 292/142

* cited by examiner

*Primary Examiner*—Lloyd A. Gall
(74) *Attorney, Agent, or Firm*—Dennison, Schultz, Dougherty & MacDonald

(57) ABSTRACT

A door lock comprises a housing having two plates to be mounted on opposite sides of a door respectively and a position base at between the plates. A driving mechanism has two handles pivoted on the plates respectively for swing, two pawls provided on the handles respectively having ends thereof extended inwards at between the plates and two arms received in the housing and pivoted thereon to be driven by the pawls respectively. A driven mechanism has gears provided on the position base to be driven for rotation by the arms and a sliding block driven by the gears for reciprocation along a predetermined orientation. A locking mechanism has a button and a pressing plate. The button is pressed to make the pressing plate moving the gears away from the pawl, so that the gears will not be driven by the pawl.

7 Claims, 5 Drawing Sheets

DOOR LOCK

BACKGROUND OF THE INVENTION

1. Field of the Invention

The present invention relates generally to a lock, and more particularly to a door lock, which is operated by pushing or pulling a handle and the door lock is easy to operate and is free from damage by false operation.

2. Description of the Related Art

U.S. Pat. No. 6,327,880 taught a door lock, which is locked and unlocked by pushing or pulling a handle. The door lock is provided with the handle at indoors or at outdoors to unlock and lock the door. The door lock also is provided with a button at indoors that the button is pressed to make the lock only unlocked at indoors but outdoors.

Such door lock is complex in structure and an interior mechanism of the button is just a tenon, which stops the unlock actions of door lock. The user can't identify which situation is the tenon stops the action of the door lock and which situation is the door lock malfunctions. If the user were exerted on the handle very hard while the button is pressed, the tenon will be broken or deformed sometime.

SUMMARY OF THE INVENTION

The primary objective of the present invention is to provide a door lock, which can prevent the interior mechanism from damage while the handle is pulled or pushed very hard.

The secondary objective of the present invention is to provide a door lock, which user can change the way of the door lock to be unlock to meet various doors.

According to the objectives of the present invention, a door lock comprises a housing having two plates to be mounted on opposite sides of a door respectively and a position base at between the plates. A driving mechanism has two handles pivoted on the plates respectively for swing, two pawls provided on the handles respectively having ends thereof extended inwards at between the plates and two arms received in the housing and pivoted thereon to be driven by the pawls respectively. A driven mechanism has gears provided on the position base to be driven for rotation by the arms and a sliding block driven by the gears for reciprocation along a predetermined orientation.

DETAILED DESCRIPTION OF THE INVENTION

Figure 1:
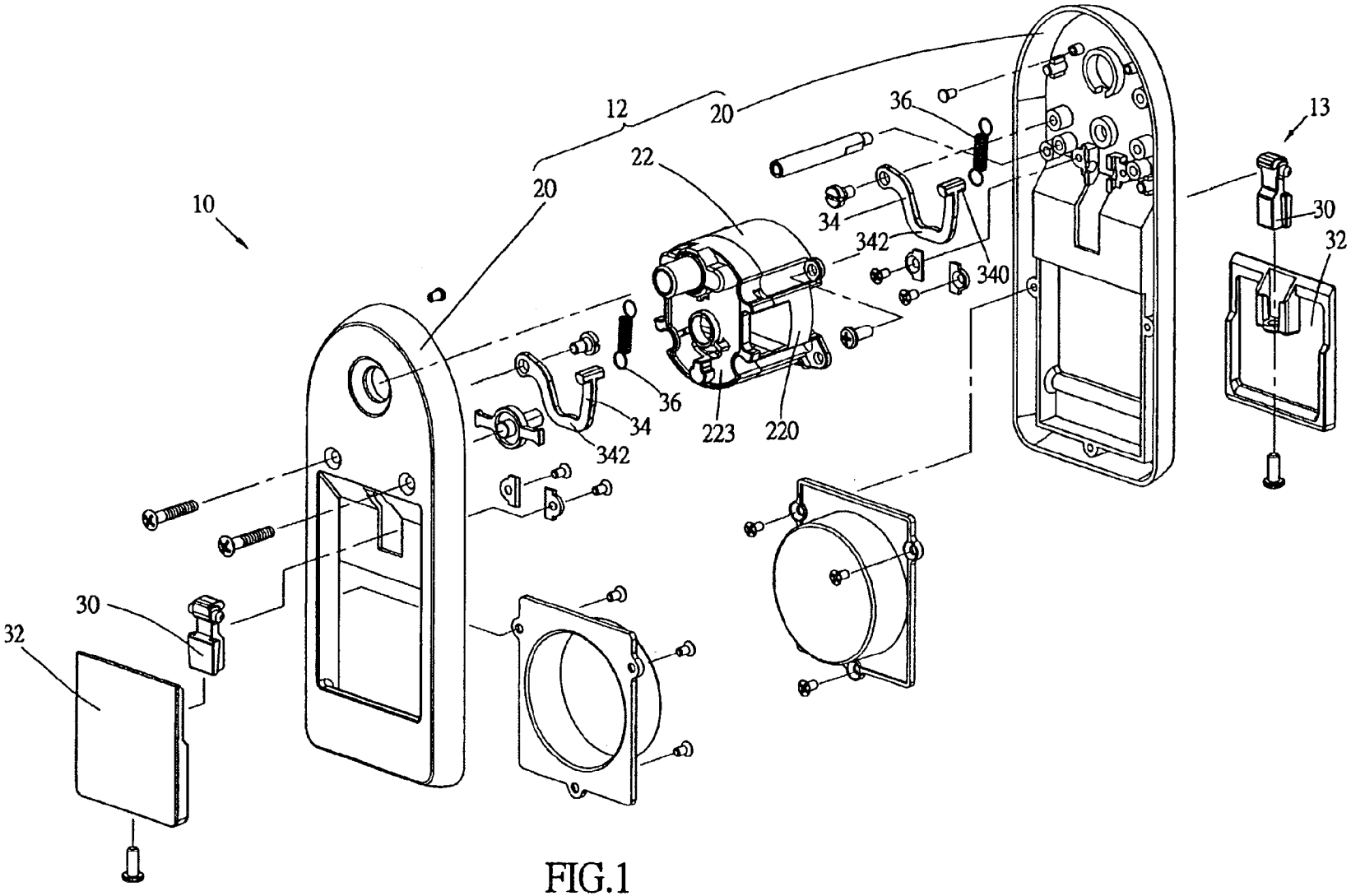
FIG. 1 is an exploded view of a preferred embodiment of the present invention.
Figure 2:
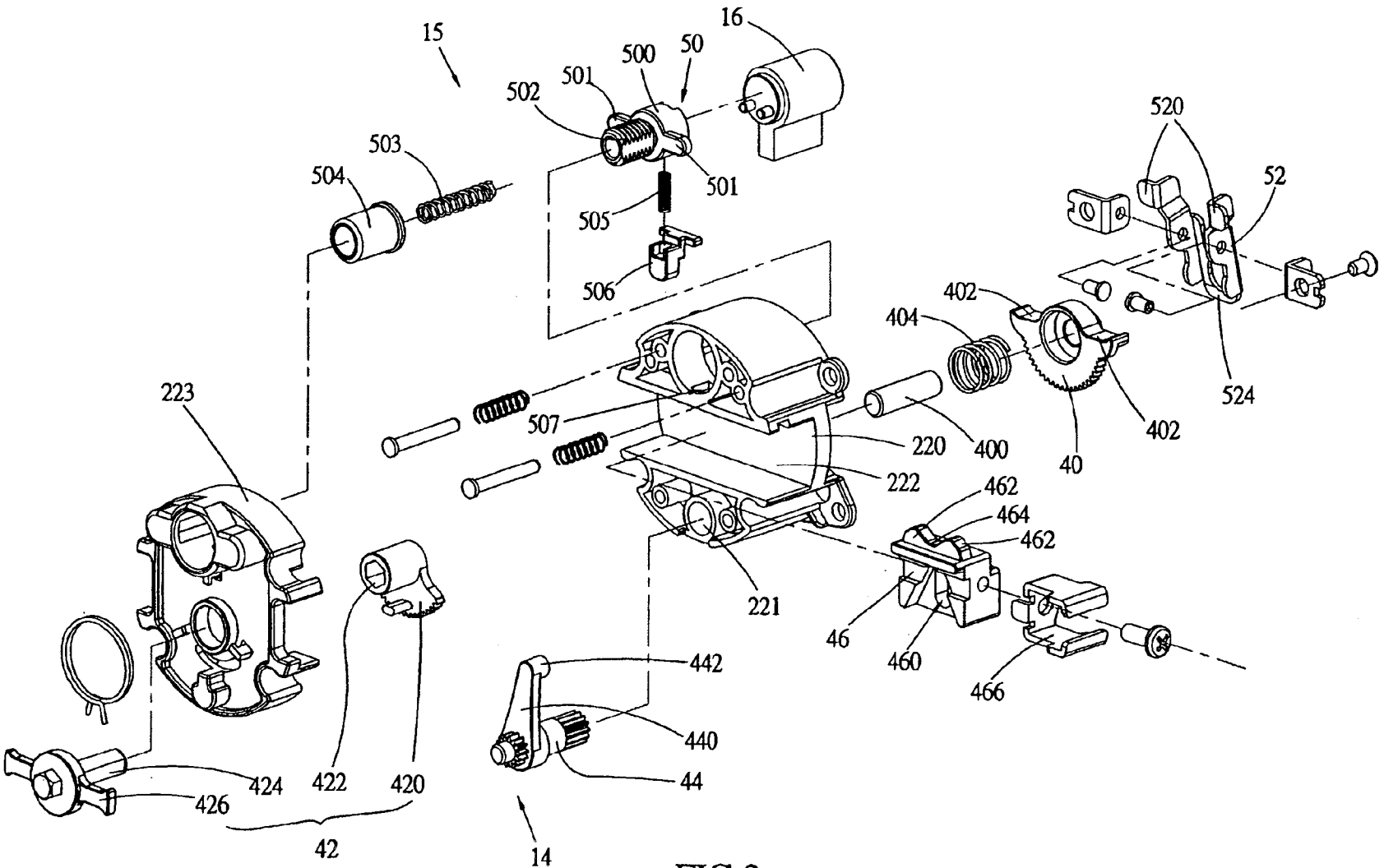
FIG. 2 is an exploded view of the driven mechanism of the preferred embodiment of the present invention.
Figure 3:
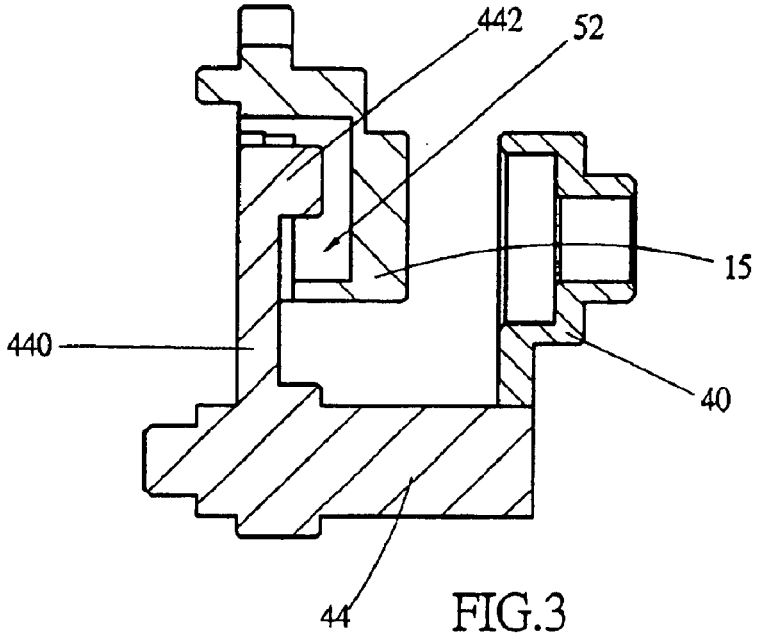
FIG. 3 is a sectional view of the driven mechanism of the preferred embodiment of the present invention.
Figure 4:
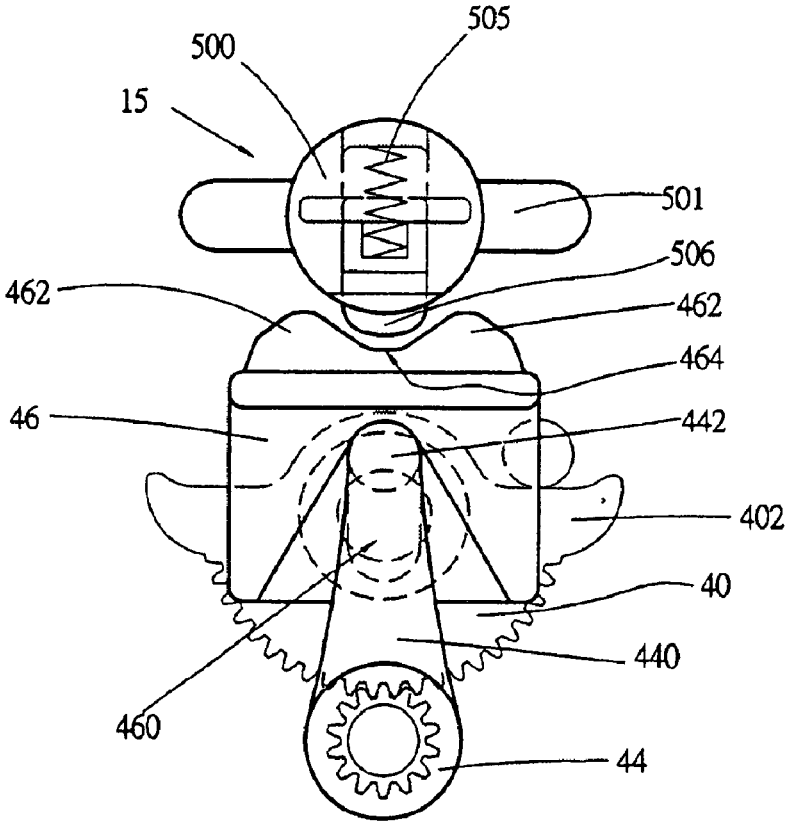
FIG. 4 is a front view of the preferred embodiment of the present invention, showing the sliding block at the locking position.
Figure 5:
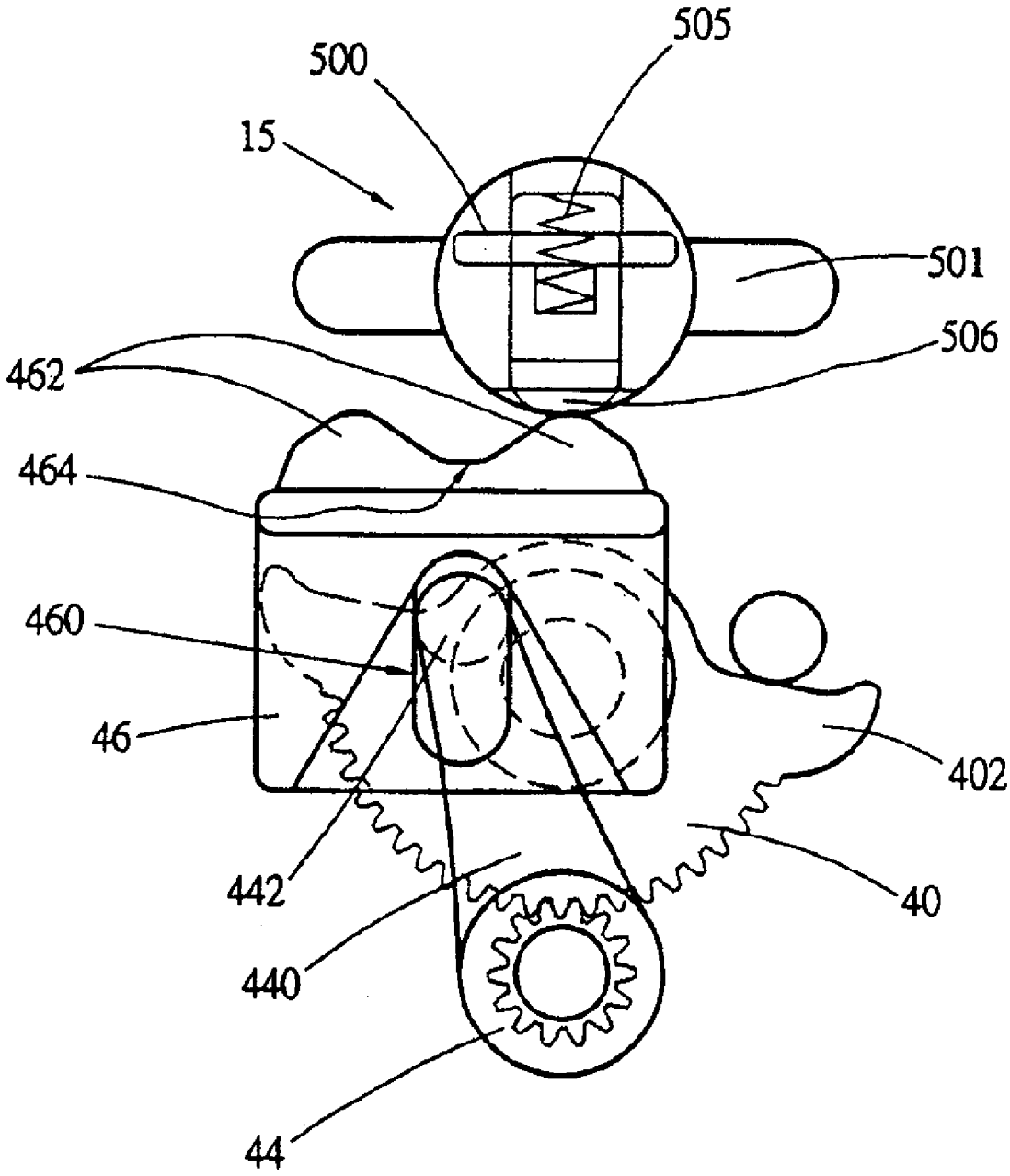
FIG. 5 is a front view of the preferred embodiment of the present invention, showing the sliding block at the unlocking position.

As shown in FIG. 1 and FIG. 2, a door lock 10 of the preferred embodiment of the present invention mainly comprises a housing 12, a driving mechanism 13 and a driven mechanism 14 mounted in the housing 12 and a locking mechanism 15.

The housing 12 has a pair of plates 20 fixed at opposite sides of a door (not shown) respectively, a position base 22 having a base member 220 and a cover 223 to be secured between the plates 20 and in a hole (not shown) of the door by screws. The base member 220 has a through hole 221 and a transverse guiding slot 222 and the cover 223 is coupled with the base member 220 at the side having the guiding slot 222.

The driving mechanism 13 has a pair of pawls 30 pivoted on interior sides of the plates 20 respectively. The pawls 30 are pivoted on the plates 20 at middle sections thereof and have tail sections extended to exterior sides of the plates 20 via holes of the plates 20 respectively. A pair of handles 32 are pivoted on the exterior sides of the plates 20 and are coupled with the tail end of the pawls 30 respectively. A pair of arms 34 are pivoted on the interior sides of the plates 20 respectively, each of which has a hook 340 at a distal end thereof and a middle section 342 beside a top end of the corresponding pawl 30. A pair of springs 36 have opposite ends connected to the hooks 340 and the interior sides of the plates 20 respectively. The springs 36 respectively keep the handles 32 attached on the exterior sides of the plates 20 at initial via the middle sections 342 of the arms 34 and the pawls 30.

The driven mechanism 14 has a first gear 40 having a shaft 400 pivoted on the position base 22 between a rear side of the position base 22 and the plate 20. The first gear 40 has a pair of first flank portions 402 respectively at opposite sides of a periphery thereof. A spring 404 is mounted between a front end of the first gear 40 and the position base 22. A second gear 42 is received in the position base 22 and pivoted thereon. The second gear 42 has a body portion 420 having a through hole 422 and a hexagonal shaft 424 having a pair of second flank portions 426 respectively at opposite sides of a periphery thereof. The through hole 422 is hexagonal to form a lock portion. The shaft 424 is pivoted on the cover 223 between a front end of the cover 223 and the plate 20 and is inserted into the through hole 422 of the body portion 420. A third gear 44 is pivoted on the base member 20 and is received in the through hole 221. The third gear 44 is meshed with the first and the second gear 40 and 42. The third gear 44 has a crank 440 and a connecting portion 442 at a distal end of the crank 440. A sliding block 46 is received in the guiding slot 222 for slide along the guiding slot 222. The sliding block 46 is connected to a lock tongue (not shown) via a connector 466. The sliding block 46 has a slot 460 at a center thereof in which the connecting portion 442 is inserted, two pushing portions 462 in symmetry at a top thereof and a recess 464 between the pushing portions 462.

The locking mechanism 15 has a button 50 for movement frontward and rearward on the position base 22 and a pressing plate 52 for swing at a rear end of the position base 22. The button 50 has a main member 500 disposed in a hole of the position base 22 having a pair of ear portions 501 at a periphery thereof in symmetry and a thread tube 502 at a front end thereof, a first spring 503 is received in the thread tube 502, a cover 504 screwed onto the thread tube 502 and exerted by the first spring 503, a second spring 505 disposed at a bottom of the main member 500 and a tenon 506 disposed at the bottom of the main member 500 and exerted by the second spring 505. The pressing plate 52 pivots a middle section thereof on the rear end of the position base 22, which has a top end 520 behind the ear portions 501 and a bottom end 524 behind the first gear 40.

The door lock 10 is locked and unlocked by a key (not shown). A core 16 is mounted between the position base 22 and the plate 20 which a interior end thereof is oriented to an inside of the main member 500 to move the tenon upwards.

In operation of the handle 32 at a rear, while the handle 32 is pulled at the bottom end thereof, the pawl 30 is swung to press the middle section 342 of the arm 34 downwardly and the hook 340 of the arm 34 presses the first flank portion 402 at the right of the first gear 40 to turn the first gear 40 a predetermined angle. And then, the second gear 42 is turned by the first gear 40 via the third gear 44 to turn the crank 44 leftwards from an upright position and the crank 44 moves the sliding block 46 and the connector 466. At last, the lock tongue is moved by the connector 466 to unlock the door lock 10 of the present invention.

It has to be mentioned that the handle 32 at the opposite side will not be moved in aforesaid operation.

Figure 6:
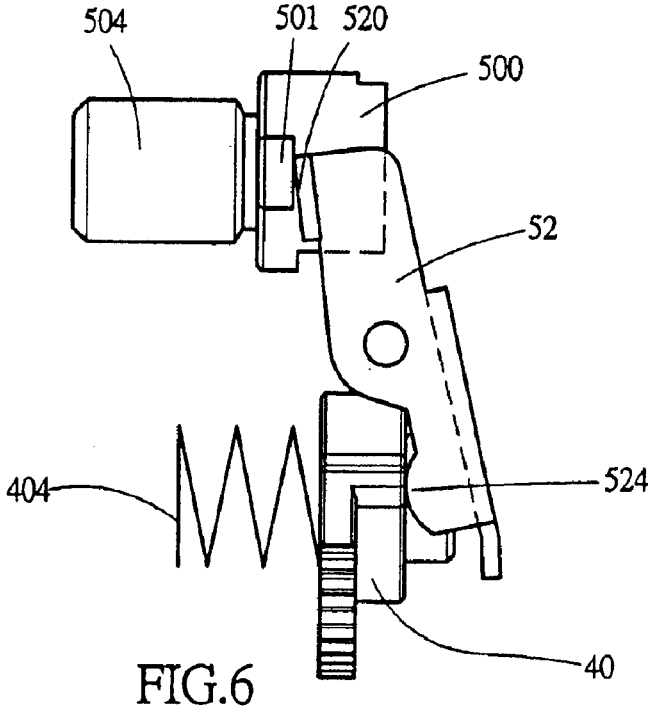
FIG. 6 is a lateral view of the locking mechanism of the preferred embodiment of the present invention, showing the first gear being released.
Figure 7:
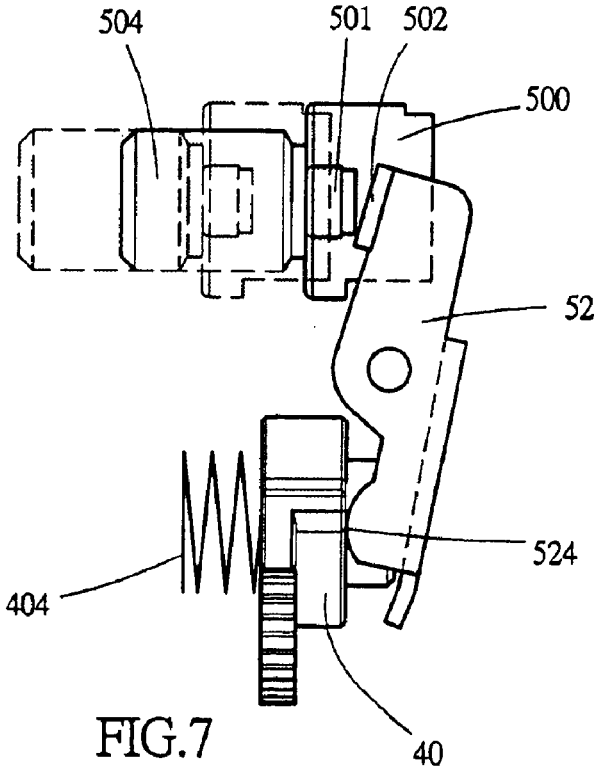
FIG. 7 is lateral view of the locking mechanism of the preferred embodiment of the present invention, showing the first gear being secured.

When the button 50 is moved from a first position to a second position, the ear portions 501 is moved along with it to push the top end 520 of the pressing plate 52 rearwards and, in the meantime, the bottom end 524 of the pressing plate 52 is swung frontward and drives the first gear 40 compressing the spring 404 for movement of a predetermined distance, as shown in FIG. 6 and FIG. 7. The first flank portions is moved away from the hook 340 of the arm 34, so that while the handle 32 is pulled, the gear 40, 42 and 44 can not be turned.

The position base 22 is provided with a locking slot 507, which is a through hole at between the button 50 and the sliding block 46. The spring 505 is extended to force the tenon 506 inserted into the locking slot 507 while the button is moved to the second position. The button 50 is secured by the tenon 506 to make the gears 40, 42 and 44 can not be turned from outside.

While the handle 32 at outside is pulled or pressed to drive the sliding block 46 moving to left or moving to right, there is one the pushing portions 462 of the sliding block 46 that pushes the tenon 506 out of the locking slot 507 and the first gear 40 and the button 50 are moved back to the initial positions respectively via the spring 404.

The key can turn the core 16 directly to force the tenon 506 moving out of the locking slot 507.

What is claimed is:

1. A door lock, comprising:

a housing having two plates to be mounted on opposite sides of a door respectively and a position base at between the plates;

a driving mechanism having two handles pivoted on the plates respectively for swing, two pawls provided on the handles respectively having ends thereof extended inwards at between the plates and two arms received in the housing and pivoted thereon to be driven by the pawls respectively, and a driven mechanism having gears provided on the position base to be driven for rotation by the arms and a sliding block driven by the gears for reciprocation along a predetermined orientation;

wherein the gears have a first gear, a second gear and a third gear;

wherein the first gear is pivoted on the position base at between the position base and one of the plates and has two first flank portions, corresponding to one of the pawls;

wherein the second gear is pivoted on the position base and has two second flank portions corresponding to the other one of the pawls;

wherein the third gear is pivoted on the position base and meshed with the first gear and the second gear having a crank at a middle section thereof to move the sliding block for reciprocation.

2. The door lock as defined in claim 1, wherein the second gear has a body portion and a shaft, wherein the body portion is meshed with the third gear and the shaft has an end thereof inserted into a through hole of the body portion and has the second flank portions at the other end thereof and further wherein the second gear has means for securing the shaft in the through hole of the body portion.

3. A door lock, comprising:

a housing having two plates to be mounted on opposite sides of a door respectively and a position base at between the plates;

a driving mechanism having two handles pivoted on the plates respectively for swing, two pawls provided on the handles respectively and having ends thereof extended inwards at between the plates and two arms received in the housing and pivoted thereon to be driven by the pawls respectively;

a driven mechanism having gears provided on the position base to be driven for rotation by the arms and a sliding block is driven by the gears for reciprocation along a predetermined orientation, and a locking mechanism having a button provided on the position base for reciprocation between a first position and a second position and a pressing plate having a middle section pivoted on the position base and having a top end corresponding to the button and a bottom end corresponding to the gears, wherein while the button is moved to the first position, the gears are in a condition of adapted to be driven by a pawl for moving the sliding block, and wherein when the button is moved to the second position, the pressing plate moves the gears away from the pawl, so that the gears will not be driven by the pawl.

4. The door lock as defined in claim 3, wherein the position base is provided with a locking slot and the button has a tenon to be inserted into the locking slot while the button is moved to the second position and to be moved out of the locking slot while the button is moved to the first position.

5. The door lock as defined in claim 4, wherein the position base is provided with a core at a predetermined position and the core has an end thereof extended out of the plate and has the other end thereof extended to a position adjacent to the tenon to stop the tenon escaping from the locking slot.

6. The door lock as defined in claim 4, wherein the locking slot is above the sliding block and the sliding block has a pushing portion which corresponds to the button, whereby the pushing portion can move the tenon out of the locking slot while the sliding block is moved to a predetermined position.

7. The door lock as defined in claim 6, wherein the sliding block has two pushing portions and a recess between the pushing portions, wherein the tenon is rested in the recess while the sliding block is moved to a middle position and the tenon is moved by one of the pushing portions to release the button from the second position thereof while the sliding block is moved away from the middle position.

* * * * *